US005437570A

United States Patent [19]

Landhuis

[11] Patent Number: 5,437,570

[45] Date of Patent: Aug. 1, 1995

[54] APPARATUS FOR MAKING CUTOUTS IN THE ENDS OF TUBULAR WORKPIECES

[75] Inventor: Jan J. Landhuis, Vriezenveen, Netherlands

[73] Assignee: ALMI Machinefabriek BV, Vriezenveen, Netherlands

[21] Appl. No.: 221,820

[22] Filed: Mar. 31, 1994

Related U.S. Application Data

[63] Continuation-in-part of Ser. No. 71,562, Jun. 3, 1993, Pat. No. 5,357,714.

[30] Foreign Application Priority Data

Apr. 2, 1993 [DE] Germany ..... 43 10 887.3

[51] Int. Cl.[6] ..... B24B 21/12

[52] U.S. Cl. ..... 451/296; 451/311

[58] Field of Search ..... 51/148, 141, 135 R, 51/135 BT, 170 EB, 262 R; 451/311, 303, 296, 355, 297, 442

[56] References Cited

U.S. PATENT DOCUMENTS

| | | | |
|---|---|---|---|
| 294,766 | 3/1884 | Coy | 451/313 |
| 344,835 | 7/1886 | Hollister | 51/148 |
| 1,841,411 | 1/1932 | Kux . | |
| 2,632,981 | 3/1953 | Kniep, Jr. | 51/135 |
| 2,802,310 | 8/1957 | Chaplik . | |
| 2,934,864 | 5/1960 | Karbowski | 451/303 |
| 3,153,306 | 10/1964 | Robischung . | |
| 5,185,962 | 2/1993 | Liou | 51/148 |

FOREIGN PATENT DOCUMENTS

| | | | |
|---|---|---|---|
| 647853 | 12/1950 | United Kingdom . | |
| 872366 | 7/1961 | United Kingdom . | |
| 0237379 | 6/1969 | U.S.S.R. | 51/135 BT |

*Primary Examiner*—Robert A. Rose
*Attorney, Agent, or Firm*—Darby & Darby

[57] ABSTRACT

An apparatus for grinding cutouts in the ends of pipes has a pair of pulleys which carry a grinding belt. One of the pulleys is a driving pulley for the belt and the other pulley is a shaping pulley which cooperates with the grinding belt to form the cutouts. A pipe clamp is located near, and is movable towards and away from, the shaping pulley. The shaping pulley is interchangeable in order to permit changes in cutout size. To this end, a stub projects from either end of the shaping pulley and supports a ball bearing. The ball bearings are receivable in carriers having U-shaped openings so that the shaping pulley can be installed and removed by pushing the bearings into the openings and pulling the bearings out of the openings.

9 Claims, 2 Drawing Sheets

APPARATUS FOR MAKING CUTOUTS IN THE ENDS OF TUBULAR WORKPIECES

CROSS-REFERENCE TO RELATED APPLICATION

This application is a continuation- in-part of application Ser. No. 08/071,562 filed 03 Jun. 1993 now U.S. Pat. No. 4,357,714.

FIELD OF THE INVENTION

The invention relates to an apparatus for shaping workpieces.

BACKGROUND OF THE INVENTION

The above-referenced application discloses an apparatus for making cutouts in the ends of tubular workpieces. The apparatus comprises an endless abrasive band which passes around and is driven along an endless path by a pair of pulleys. Formation of a cutout takes place at one of the pulleys and this shaping pulley has a diameter approximating the desired diameter of the cutout. The apparatus further comprises a workpiece clamp which is supported on a carriage movable towards and away from the shaping pulley.

The shaping pulley is interchangeable in order to change the cutout diameter. However, improvements in the ease and speed of pulley insertion and removal are desirable.

SUMMARY OF THE INVENTION

It is an object of the invention to provide a shaping apparatus having a shaping pulley which can be installed and removed relatively quickly.

Another object of the invention is to provide a shaping apparatus having a shaping pulley which is capable of being inserted and withdrawn relatively simply.

The preceding objects, as well as others which will become apparent as the description proceeds, are achieved by the invention.

One aspect of the invention resides in an apparatus for shaping workpieces, particularly the ends of tubular workpieces. The apparatus comprises means for gripping a workpiece to be shaped, means for moving the gripping means towards and away from a shaping location, and means for shaping the workpiece. The shaping means includes a pair of pulleys, and an endless abrasive element passing around the pulleys. In addition, the apparatus comprises means for tensioning and loosening the endless abrasive element. One of the pulleys has opposed ends, and a shaft segment projecting from each of the ends. The apparatus further comprises means for interchangeably mounting such pulley at the shaping location, and the mounting means includes a bearing element on each of the shaft segments and a pair of carriers at the shaping location for the respective bearing elements. Each of the carriers is provided with an opening designed to receive one of the bearing elements, and each of the openings has an open end for insertion of the respective bearing element therein and a closed end spaced from the respective open end.

By providing the tensioning and loosening means and by providing the interchangeable pulley with bearing elements and designing the carriers for the pulley with openings which allow the bearing elements to be pushed in and pulled out, the invention makes it possible to install and remove the interchangeable pulley easily and expeditiously.

BRIEF DESCRIPTION OF THE DRAWINGS

Other features and advantages of the invention will become apparent from the following detailed description of certain preferred embodiments when read in conjunction with the accompanying drawings.

DESCRIPTION OF PREFERRED EMBODIMENTS

Figure 1:
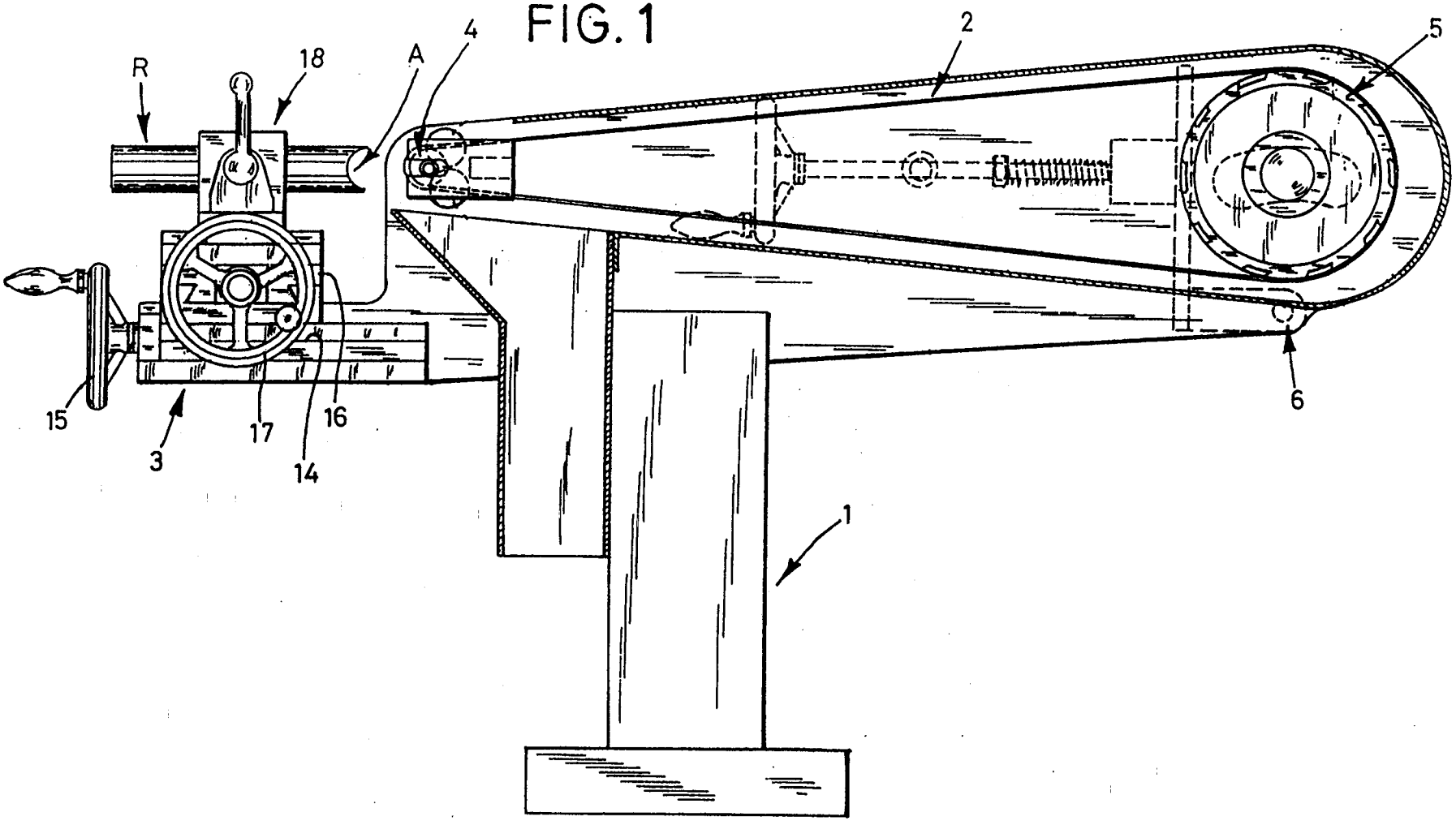
FIG. 1 is a side elevation of a shaping apparatus in accordance with the invention.

FIG. 1 illustrates an apparatus for shaping the end of a pipe or tubular workpiece R by forming a cutout or recess A in such end. The shaping apparatus has a base or stand 1 which supports a machine frame. The machine frame, in turn, carries a front shaping pulley. 4 and a rear driving pulley 5 which is driven by a non-illustrated motor. The driving pulley 5 and its motor are mounted on a support member pivoted to the machine frame via a pivot 6. By this arrangement, the rear pulley is guided between a first position where the endless abrasive element or belt is in a tensioned state, and a second position, where the endless abrasive element or belt is in a loosened state. During such movement of the rear pulley, the front pulley remains stationary. A grinding or abrasive belt 2 passes around the shaping pulley 4 and the driving pulley 5.

The machine frame further carries a support 3 which is located in front of the shaping pulley 4. Mounted on the support 3 is a carriage 14 displaceable longitudinally of the machine frame, that is, transverse to the axes of the pulleys 4,5. The carriage 14 is movable towards and away from the shaping pulley 4 by means of a handwheel 15. A second carriage 16 is also disposed on the support 3 and is shiftable transversely of the maching frame, i.e., parallel to the axes of the pulleys 4,5. The carriage 16 can be moved back-and-forth along the shaping pulley 4 by a second handwheel 17.

A clamping mechanism 18 is mounted on the carriages 14,16 and is designed to clamp or grip pipes of different diameter.

In order to form cutouts of different sizes, the shaping pulley 4 is mounted on the machine frame so as to be easily interchangeable. A mounting arrangement which permits rapid installation of the shaping pulley 4 on, and rapid removal of the shaping pulley 4 from, the machine frame is shown in FIG. 2.

Figures 2, 3, 4:
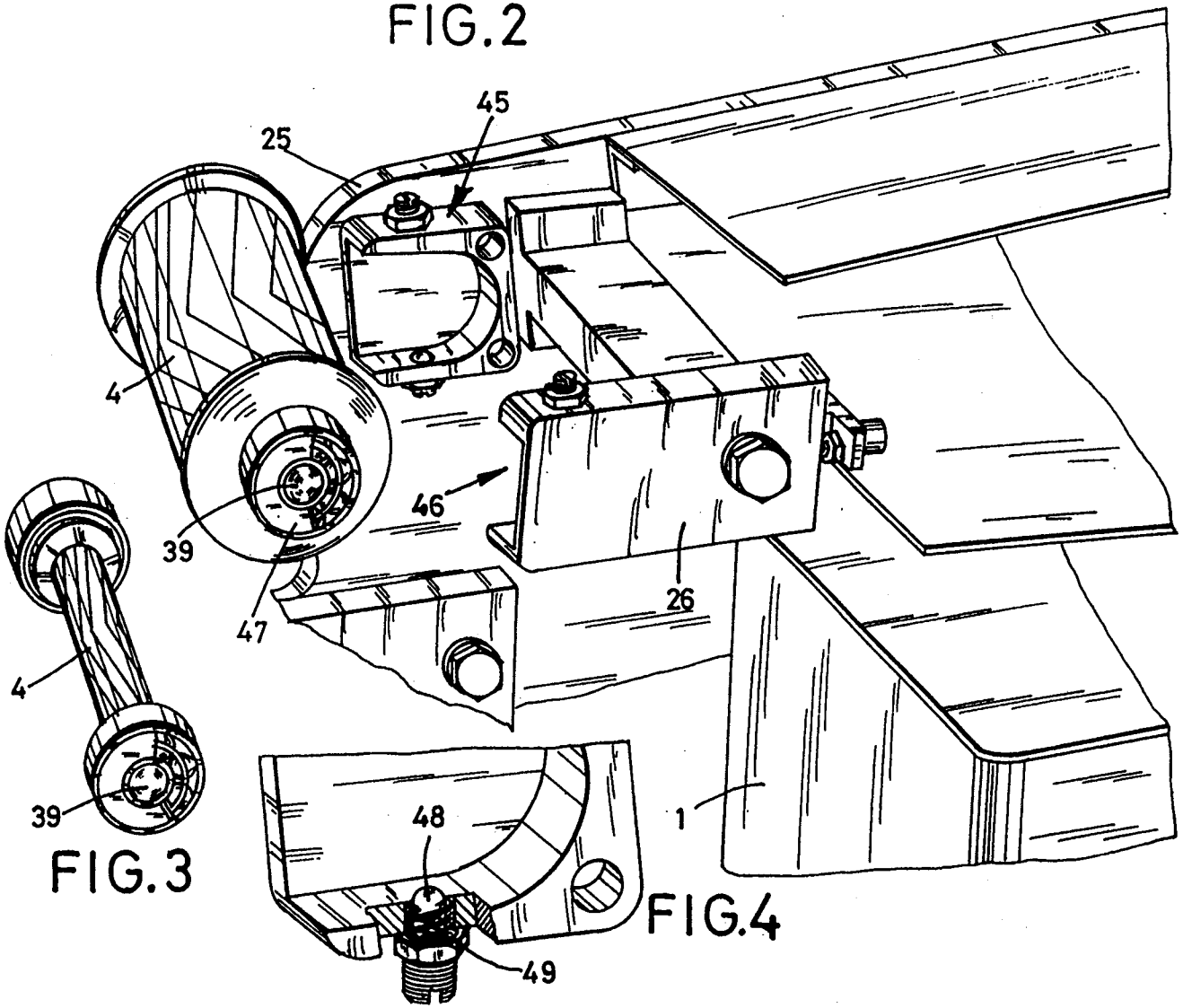
FIG. 2 is an enlarged fragmentary perspective view depicting the installation of a pulley of relatively large diameter in the shaping apparatus.
FIG. 3 is a perspective view of a pulley of relatively small diameter designed for installation in the shaping apparatus.
FIG. 4 is .an enlarged fragmentary perspective view showing a detail of a pulley carrier constituting part of the shaping apparatus.

In FIG. 2, the reference numerals 25 and 26 identify opposed side walls of a housing on, or constituting part of, the machine frame. The side walls 25 and 26 respectively support carriers 45 and 46 having U-shaped openings. In the illustrated embodiment, the open end of each U-shaped opening faces to the front, that is, towards the support 3. However, it is possible for the U-shaped openings to be oriented differently. Near the open front end of each U-shaped opening are two arresting devices which are situated at the respective legs of such opening. As illustrated in FIG. 4, each arresting device includes a ball 48 which is biased by a spring 49 so that it projects into the respective opening.

A stub or shaft segment 39 projects from either axial end of the shaping pulley 4 and extends along the axis of rotation thereof. An annular bearing element 47, preferably a ball bearing, is mounted on each of the stubs 39. The bearing elements 47 are designed to fit snugly into the U-shaped openings of the carriers 45 and 46.

With reference to FIG. 2, the shaping pulley 4 can be installed in the shaping apparatus by placing the bearing elements 47 in front of the open ends of the U-shaped openings and then pushing the bearing elements 47 towards the closed ends of the openings. As the bearing elements 47 travel towards the closed ends of the U-shaped openings, they pass over the arresting devices 48,49. The balls 48 of the arresting devices 48,49 then arrest the bearing elements 47 to retain the latter in the U-shaped openings.

FIG. 3 shows a shaping pulley 4 of much smaller diameter than the shaping pulley 4 of FIG. 2. A stub 39 15 projects from either axial end of the shaping pulley 4 of FIG. 3 and each such stub 39 again carries abearing element. The bearing elements of FIG. 3 have the same diameter as the bearing elements 47 of FIG. 2 so that, in accordance with the inventive concept, the shaping pulley 4 of FIG. 3 can be quickly and easily substituted for the shaping pulley 4 of FIG. 2.

In order to remove a shaping pulley 4 from the shaping apparatus, the belt 2 is slackened by displacing the driving pulley 5. The belt 2 is then removed from the shaping pulley 4 which is thereupon pulled out of the carriers 45,46. Another shaping pulley 4 is inserted in the carriers 45,46 and the slack belt 2 is placed over the new shaping pulley 4. The belt 2 is now tightened by appropriately shifting the driving pulley 5 so that the shaping apparatus is again operable.

To facilitate removal of the belt 2 from a shaping pulley 4, the side wall 26 is in the form of an angular component carried by the machine frame.

various modifications can be made within the meaning and range of equivalence of the appended claims.

I claim:

1. An apparatus for shaping ends of workpieces, comprising:

means for gripping an elongated workpiece to be shaped;

means for moving said gripping means towards and away from a shaping location;

means for shaping an end of the workpiece at said shaping location so as to form a recess therein, said gripping and moving means cooperating with each other for bringing said end of the workpiece towards and away from said shaping location, said shaping means including a driving pulley, an interchangeable pulley, and an endless abrasive element passing around said pulleys, one of said pulleys having opposed ends and a shaft segment projecting from each of said ends;

means for interchangeably mounting said interchangeable pulley at said shaping location, said means for interchangeably mounting comprising a bearing element on each of said segments and a pair of carriers at said shaping location for the respective bearing elements, each of said carriers being provided with an opening designed to receive one of said bearing elements, and each of said openings having an open end for insertion of the respective bearing element therein and a closed end spaced from the respective open end;

at least another pulley that is interchangeable with said interchangeable pulley at said shaping location, said another pulley also having opposed ends and a shaft segment projecting from each of said ends, said means for interchangeably mounting comprising a bearing element on each of said segments of said another pulley that are identical to those on each of said segments of said interchangeable pulley, said interchangeable pulley having a diameter about which said endless abrasive element passes that differs in dimension from that of said another pulley; and an arresting device situated at each of the respective openings.

2. The apparatus of claim 1, wherein said openings are substantially U-shaped.

3. The apparatus of claim 1, wherein said moving means comprises a carriage.

4. The apparatus of claim 1, wherein said bearing elements are substantially annular.

5. The apparatus of claim 4, wherein said bearing elements comprise ball bearings.

6. The apparatus of claim 1, wherein said gripping means is configured to grip tubular workpieces of different diameters.

7. The apparatus of claim 1, wherein each of said arresting devices includes a ball and a spring, said spring biasing said ball so that said ball projects into the corresponding one of said openings.

8. The apparatus of claim 1, further comprising a machine frame supporting said shaping means, and said moving means includes means for moving said gripping means longitudinally and transversely of said machine frame.

9. The apparatus of claim 1, wherein said driving pulley is movable with respect to said interchangeable pulley between a first position, where said endless abrasive element is in a tensioned state, and a second position, where said endless abrasive element is in a loosened state, said driving pulley being movable away from and towards said interchangeable pulley while said interchangeable pulley remains stationary so as to respectively tension and loosen said endless abrasive element.

* * * * *

UNITED STATES PATENT AND TRADEMARK OFFICE

CERTIFICATE OF CORRECTION

PATENT NO. : 5,437,570

DATED : August 1, 1995

INVENTOR(S) : Jan J. LANDHUIS

It is certified that error appears in the above-indentified patent and that said Letters Patent is hereby corrected as shown below:

Col. 1, line 9, change "4,357,714" to --5,357,714--.

Signed and Sealed this

Third Day of October, 1995

*Attest:*

Bruce Lehman

BRUCE LEHMAN

*Attesting Officer*

*Commissioner of Patents and Trademarks*